US009180498B2

(12) United States Patent
Jendrichowski et al.

(10) Patent No.: US 9,180,498 B2
(45) Date of Patent: Nov. 10, 2015

(54) BEVERAGE BOTTLING PLANT CONFIGURED TO FILL ALREADY USED, RETURNED, RETURNABLE BEVERAGE BOTTLES WHICH INCLUDES A CLEANING MACHINE, AND A CLEANING MACHINE

(75) Inventors: Klaus Jendrichowski, Holzwickede (DE); Falk Dittrich, Castrop-Rauxel (DE); Ulrich Wiedemann, Dortmund (DE); Elmar Hein, Dortmund (DE); Bernd Molitor, Fröndenberg (DE)

(73) Assignee: KHS GmbH, Dortmund (DE)

( * ) Notice: Subject to any disclaimer, the term of this patent is extended or adjusted under 35 U.S.C. 154(b) by 411 days.

(21) Appl. No.: 12/761,920

(22) Filed: Apr. 16, 2010

(65) Prior Publication Data

US 2010/0263324 A1 Oct. 21, 2010

Related U.S. Application Data

(63) Continuation-in-part of application No. PCT/EP2008/008707, filed on Oct. 15, 2008.

(30) Foreign Application Priority Data

Oct. 16, 2007 (DE) ..... 10 2007 049 724
Nov. 12, 2007 (DE) ..... 10 2007 054 149

(51) Int. Cl.
*B08B 9/20* (2006.01)
*B08B 9/42* (2006.01)

(52) U.S. Cl.
CPC ..... *B08B 9/423* (2013.01)

(58) Field of Classification Search
USPC ..... 53/167, 147, 249; 198/803.12, 803.13, 198/803.14, 867.11, 867.12, 803.3
See application file for complete search history.

(56) References Cited

U.S. PATENT DOCUMENTS 1,756,554 A * 4/1930 Hippenmeyer ..... 198/867.12
1,934,250 A * 11/1933 Wynne et al. ..... 198/468.11

(Continued)

FOREIGN PATENT DOCUMENTS

DE 25 57 356 B1 3/1977
DE 86 33 675 U1 4/1987

(Continued)

OTHER PUBLICATIONS

International Search Report PCT/EP2008/008707.

(Continued)

*Primary Examiner* — Gloria R Weeks
(74) *Attorney, Agent, or Firm* — Nils H. Ljungman & Associates

(57) ABSTRACT

A beverage bottling plant configured to fill already used, returned, returnable beverage bottles which includes a cleaning machine, and a cleaning machine configured to clean used, returnable, cleanable containers in a container filling plant. The abstract of the disclosure is submitted herewith as required by 37 C.F.R. §1.72(b). As stated in 37 C.F.R. §1.72 (b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

18 Claims, 6 Drawing Sheets

(56) References Cited

U.S. PATENT DOCUMENTS

| | | | | | |
|---|---|---|---|---|---|
| 2,051,091 | A | * | 8/1936 | Ladewig et al. | 198/803.15 |
| 2,984,334 | A | * | 5/1961 | Dungfelder et al. | 198/803.15 |
| 3,004,651 | A | * | 10/1961 | Manspeaker et al. | 198/483.1 |
| 3,088,473 | A | * | 5/1963 | Rogge | 134/58 R |
| 3,090,478 | A | * | 5/1963 | Stanley | 248/128 |
| 3,199,552 | A | * | 8/1965 | Nordfors | 141/313 |
| 3,474,894 | A | * | 10/1969 | Sushardt et al. | 198/803.15 |
| 3,530,971 | A | * | 9/1970 | Babunovic | 198/377.1 |
| 3,641,930 | A | | 2/1972 | Riddington | |
| 3,765,326 | A | | 10/1973 | Hawkins | |
| 3,815,758 | A | * | 6/1974 | Vandergeeten | 211/74 |
| 3,877,367 | A | | 4/1975 | Norwood | |
| 3,918,920 | A | * | 11/1975 | Barber | 422/560 |
| 3,934,500 | A | | 1/1976 | Jackson | |
| 3,941,237 | A | * | 3/1976 | MacGregor, Jr. | 198/867.13 |
| 3,960,073 | A | | 6/1976 | Rush | |
| 3,981,389 | A | * | 9/1976 | Babunovic et al. | 198/803.15 |
| 4,013,497 | A | * | 3/1977 | Wolf | 156/154 |
| 4,078,483 | A | | 3/1978 | Gall | |
| 4,194,922 | A | * | 3/1980 | Gransell et al. | 134/1 |
| 4,284,189 | A | * | 8/1981 | Vamvakas | 198/803.15 |
| 4,325,775 | A | * | 4/1982 | Moeller | 156/750 |
| 4,715,920 | A | * | 12/1987 | Ruppman et al. | 156/709 |
| 4,778,045 | A | * | 10/1988 | Grune et al. | 198/867.12 |
| 4,779,634 | A | * | 10/1988 | Gutierrez et al. | 134/133 |
| 4,804,430 | A | * | 2/1989 | Miekka et al. | 156/233 |
| 4,807,421 | A | * | 2/1989 | Araki et al. | 53/167 |
| 4,819,789 | A | * | 4/1989 | Linner | 198/803.8 |
| 4,936,442 | A | * | 6/1990 | Von Till | 198/867.12 |
| 5,014,868 | A | * | 5/1991 | Wittig et al. | 220/737 |
| 5,123,993 | A | * | 6/1992 | Wiggins | 156/750 |
| 5,159,960 | A | * | 11/1992 | Pringle | 141/1 |
| 5,207,155 | A | | 5/1993 | Thompson | |
| 5,317,794 | A | * | 6/1994 | Lerner et al. | 29/426.3 |
| 5,372,672 | A | * | 12/1994 | Seifert et al. | 156/750 |
| 5,425,402 | A | * | 6/1995 | Pringle | 141/235 |
| 5,441,063 | A | * | 8/1995 | Fernandez et al. | 134/142 |
| 5,456,563 | A | * | 10/1995 | Halbo | 414/416.06 |
| 5,509,524 | A | * | 4/1996 | Ohmori et al. | 198/465.1 |
| 5,687,847 | A | * | 11/1997 | Culpepper et al. | 206/430 |
| 5,687,874 | A | * | 11/1997 | Omori et al. | 220/737 |
| 5,718,030 | A | * | 2/1998 | Langmack et al. | 29/426.3 |
| 5,733,783 | A | * | 3/1998 | Fine et al. | 436/43 |
| 5,769,203 | A | * | 6/1998 | Marti Sala | 198/397.01 |
| 5,784,171 | A | | 7/1998 | Kano | |
| 5,853,080 | A | * | 12/1998 | Patois et al. | 198/626.1 |
| 6,039,206 | A | * | 3/2000 | DeFrancesco | 220/737 |
| 6,068,110 | A | * | 5/2000 | Kumakiri et al. | 198/803.14 |
| 6,079,546 | A | * | 6/2000 | Marti Sala | 198/465.1 |
| 6,082,418 | A | * | 7/2000 | Naecker et al. | 141/145 |
| 6,199,615 | B1 | * | 3/2001 | Klarl | 156/750 |
| 6,328,557 | B1 | * | 12/2001 | Grishchenko et al. | 432/122 |
| 6,463,964 | B2 | * | 10/2002 | Clusserath | 141/40 |
| 6,591,970 | B2 | * | 7/2003 | Olson et al. | 198/500 |
| 6,777,458 | B1 | * | 8/2004 | Jaworek et al. | 522/1 |
| 6,918,417 | B2 | * | 7/2005 | Bernhard | 141/89 |
| 6,971,506 | B2 | * | 12/2005 | Hassinen et al. | 198/803.14 |
| 7,090,087 | B1 | * | 8/2006 | Guralski | 215/395 |
| 7,121,062 | B2 | * | 10/2006 | Till | 53/167 |
| 7,162,849 | B2 | * | 1/2007 | Bernhard | 53/317 |
| 7,201,285 | B2 | * | 4/2007 | Beggins | 215/386 |
| 7,216,758 | B2 | * | 5/2007 | Hartness et al. | 198/803.7 |
| 7,261,199 | B2 | * | 8/2007 | Hartness et al. | 198/470.1 |
| 7,392,632 | B2 | * | 7/2008 | Wiedemann et al. | 53/147 |
| 7,614,516 | B2 | * | 11/2009 | Beggins | 215/386 |
| 7,708,136 | B2 | * | 5/2010 | Uriel | 198/803.11 |
| 7,980,046 | B2 | * | 7/2011 | Yousefpour et al. | 53/471 |
| 8,011,166 | B2 | * | 9/2011 | Sheets et al. | 53/127 |
| 8,079,460 | B2 | * | 12/2011 | Kurz et al. | 198/473.1 |
| 8,132,598 | B2 | * | 3/2012 | Mastio et al. | 141/51 |
| 8,132,664 | B2 | * | 3/2012 | Paskell et al. | 198/803.14 |
| 8,210,546 | B2 | * | 7/2012 | Kohler | 279/23.1 |
| 2004/0191127 | A1 | | 9/2004 | Kornblit et al. | |
| 2004/0252174 | A1 | | 12/2004 | Baxter et al. | |
| 2006/0250464 | A1 | | 11/2006 | Sheinman | |
| 2010/0263324 | A1 | * | 10/2010 | Jendrichowski et al. | 53/167 |

FOREIGN PATENT DOCUMENTS

| | | | |
|---|---|---|---|
| DE | 89 14 691 | U1 | 2/1990 |
| DE | 42 42 375 | A1 | 6/1994 |
| DE | 4424528 | | 1/1996 |
| DE | 195 42 673 | A1 | 5/1997 |
| DE | 102005041221 | | 3/2007 |
| EP | 0563102 (B1) | | 6/1994 |
| EP | 1449778 | | 8/2004 |
| EP | 1 473 079 | A1 | 11/2004 |
| EP | 1493339 | | 1/2005 |
| GB | 355 584 | A | 8/1931 |
| JP | 56028999 | U | 3/1981 |
| JP | H 0848347 | A | 2/1996 |
| JP | 2006314388 | A | 11/2006 |
| NL | 7 401 302 | A | 8/1975 |
| SU | 369 103 | | 2/1973 |

OTHER PUBLICATIONS

European Office Action 08 839 913.4-1253.

Russian Search Report 2010119503/05(027714).

* cited by examiner

BEVERAGE BOTTLING PLANT CONFIGURED TO FILL ALREADY USED, RETURNED, RETURNABLE BEVERAGE BOTTLES WHICH INCLUDES A CLEANING MACHINE, AND A CLEANING MACHINE

CONTINUING APPLICATION DATA

This application is a Continuation-In-Part application of International Patent Application No. PCT/EP2008/008707, filed on Oct. 15, 2008, which claims priority from Federal Republic of Germany Patent Application No. 10 2007 049 724.7, filed on Oct. 16, 2007. International Patent Application No. PCT/EP2008/008707 was pending as of the filing date of this application. The United States was an elected state in International Patent Application No. PCT/EP2008/008707.

BACKGROUND

1. Technical Field

The present application relates to a beverage bottling plant configured to fill already used, returned, returnable beverage bottles which includes a cleaning machine, and a cleaning machine configured to clean used, returnable, cleanable containers in a container filling plant.

2. Background Information

Background information is for informational purposes only and does not necessarily admit that subsequently mentioned information and publications are prior art.

A beverage bottling plant for filling bottles with a liquid beverage filling material can possibly comprise a beverage filling machine, which is often a rotary filling machine, with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material.

Some beverage bottling plants may possibly comprise filling arrangements that receive a liquid beverage material from a toroidal or annular vessel, in which a supply of liquid beverage material is stored under pressure by a gas. The toroidal vessel may also be connected to at least one external reservoir or supply of liquid beverage material by a conduit or supply line. In some circumstances it may even be possible that a beverage bottling plant has two external supply reservoirs, each of which may be configured to store either the same liquid beverage product or different products. These reservoirs could possibly be connected to the toroidal or annular vessel by corresponding supply lines, conduits, or other arrangements. It is also possible that the external supply reservoirs could be in the form of simple storage tanks, or in the form of liquid beverage product mixers.

A wide variety of types of filling elements are used in filling machines in beverage bottling or container filling plants for dispensing a liquid product into bottles, cans or similar containers, including but not limited to filling processes that are carried out under counterpressure for the bottling of carbonated beverages. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine.

After a filling process has been completed, the filled beverage bottles are transported or conveyed to a closing machine, which is often a rotary closing machine. A revolving or rotary machine comprises a rotor, which revolves around a central, vertical machine axis. There may further be provided a conveyer arrangement configured to transfer filled bottles from the filling machine to the closing station. A transporting or conveying arrangement can utilize transport star wheels as well as linear conveyors. A closing machine closes bottles by applying a closure, such as a screw-top cap or a bottle cork, to a corresponding bottle mouth. Closed bottles are then usually conveyed to an information adding arrangement, wherein information, such as a product name or a manufacturer's information or logo, is applied to a bottle. A closing station and information adding arrangement may be connected by a corresponding conveyer arrangement. Bottles are then sorted and packaged for shipment out of the plant.

Many beverage bottling plants may also possibly comprise a rinsing arrangement or rinsing station to which new, non-return and/or even return bottles are fed, prior to being filled, by a conveyer arrangement, which can be a linear conveyor or a combination of a linear conveyor and a starwheel. Downstream of the rinsing arrangement or rinsing station, in the direction of travel, rinsed bottles are then transported to the beverage filling machine by a second conveyer arrangement that is formed, for example, by one or more starwheels that introduce bottles into the beverage filling machine.

It is a further possibility that a beverage bottling plant for filling bottles with a liquid beverage filling material can be controlled by a central control arrangement, which could be, for example, a computerized control system that monitors and controls the operation of the various stations and mechanisms of the beverage bottling plant.

Some container or bottle cells as components of container or bottle baskets for container or bottle cleaning machines are used there for accommodating containers as the containers are transported by way of a transport system that is formed by a plurality of container or bottle baskets through the various cleaning and processing zones of the respective container or bottle cleaning machine.

In addition, in some container or bottle cells, the wall or jacket of the containers or bottles cells are produced in each case from a cylindrical or polygon-like section and a tapering section connected thereto (mouth region), the tapering section and also a part of the cylindrical or polygon-like section accommodated in a cell carrier being made entirely of plastics material, whereas a part section of the jacket protruding beyond the cell carrier and remote from the mouth region is produced from sheet metal or is reinforced by a metal plate.

In order to obtain, among other things, an optimum design for the positioning and/or securing of the containers in the container cells and/or for the processing of the containers in the container cells and/or for the flow of the processing media in the container cells, and also to obtain shaping and/or structuring of the cell inside surface in a simplified container cell production procedure, it is also possible to produce these types of container cells completely or substantially completely as molded parts made of plastics material. Such types of container cells made of plastic materials, for stability reasons, among other things, have a relatively large mass and consequently a large thermal capacity. During the operation of a container cleaning machine, due to the temperature differences between the various processing zones and due to the heating and cooling of the container cells that this brings about when they are being transported through the processing zones, this results in considerable energy losses.

OBJECT OR OBJECTS

An object of the present application is to provide a container cell that, with a high level of mechanical and thermal stability and with an optimally realized cell inside surface, in at least one possible embodiment, also with regard to shape and structuring, has a reduced thermal capacity.

SUMMARY

The present application seeks to achieve this object with a container cell of a container cleaning machine, in at least one possible embodiment a bottle cleaning machine. The container cell comprises a cell interior space that is surrounded by a cell jacket with a container cell inside surface made of plastics material for accommodating a container to be cleaned. The cell jacket, at least over the larger part of the length of a container cell, is multi-layered. The cell jacket comprises at least one thin-walled cell body or support body. The at least one thin-walled cell body or support body comprises a first material. The cell jacket comprises at least one other layer forming the container cell inside surface. The at least one other layer comprises a second material. The present application also seeks to achieve this object with a container basket for a container cleaning machine. The container basket comprises a cell carrier and a plurality of container cells provided on the cell carrier. The container cells are realized according to the present application.

In at least one possible embodiment, the container cell according to the present application, brings together the optimal usages of a container cell, which is producible by using a simple manufacturing method and is optimally structured and/or formed for the cleaning or processing of the containers at least at the container cell inside surface, with a reduced thermal capacity and, linked to this, a considerable energy saving during the operation of a container cleaning machine that is provided with the container cells according to the present application.

Further developments, possible embodiments, and application possibilities of the present application are also produced from the following description of possible embodiments and from the figures. In this case the features described and/or graphically represented, individually or in arbitrary combination, are in principle objects of the present application.

The present application relates to a container cell of a container cleaning machine, in at least one possible embodiment a bottle cleaning machine. The container cell comprises a cell interior space that is surrounded by a cell jacket with a container cell inside surface made of plastics material for accommodating a container to be cleaned. The cell jacket, at least over the larger part of the length of a container cell, is multi-layered. The cell jacket comprises at least one thin-walled cell body or support body. The thin-walled cell body or support body comprises a first material. The cell jacket comprises at least one other layer forming the container cell inside surface. The at least one other layer comprises a second material. The present application also relates to a container basket for a container cleaning machine. The container basket comprises a cell carrier and a plurality of container cells provided on the cell carrier. The container cells are realized according to the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is explained below by way of the figures of possible embodiments, in which, in detail.

DESCRIPTION OF EMBODIMENT OR EMBODIMENTS

Figure 1:
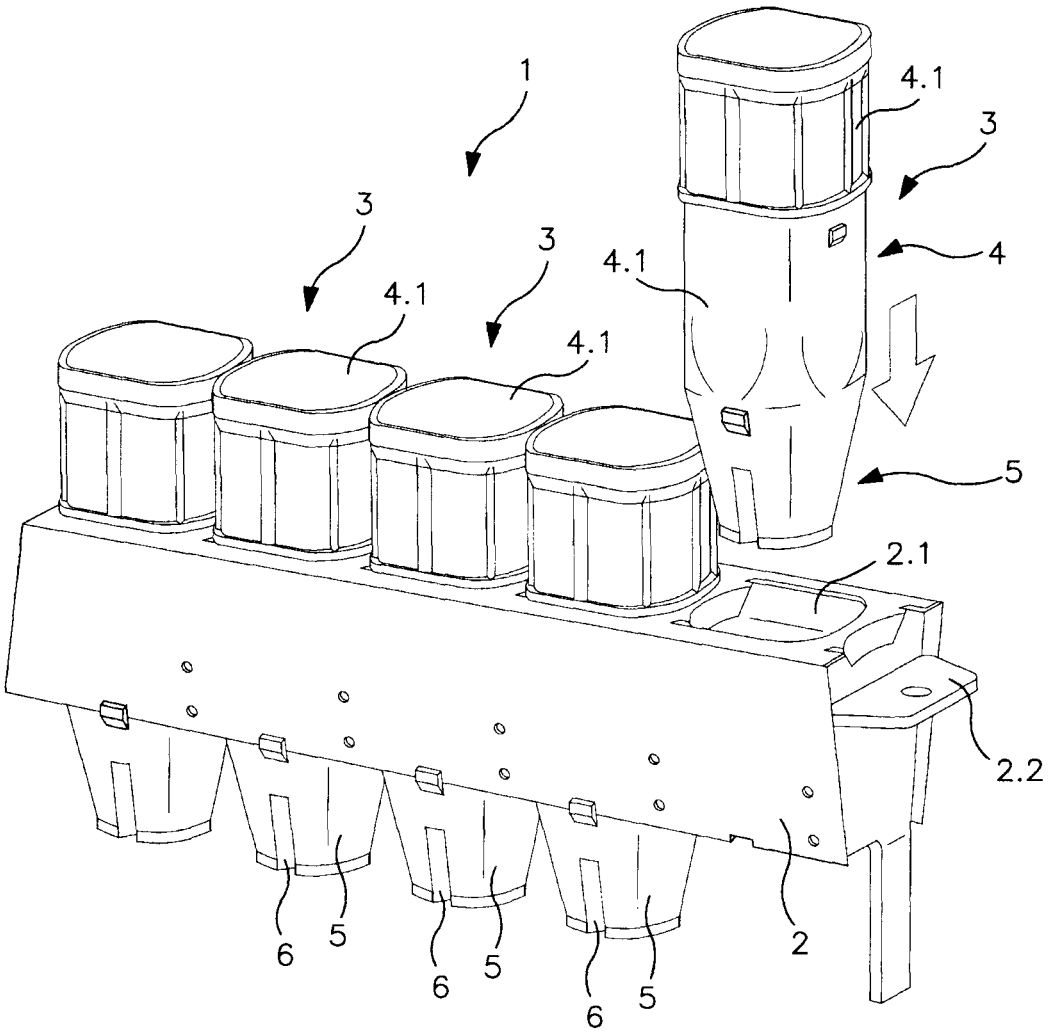
FIG. 1 shows a simplified part representation in perspective of a container basket comprising a cell carrier and a plurality of bottle or container cells provided on said cell carrier.
Figure 2:
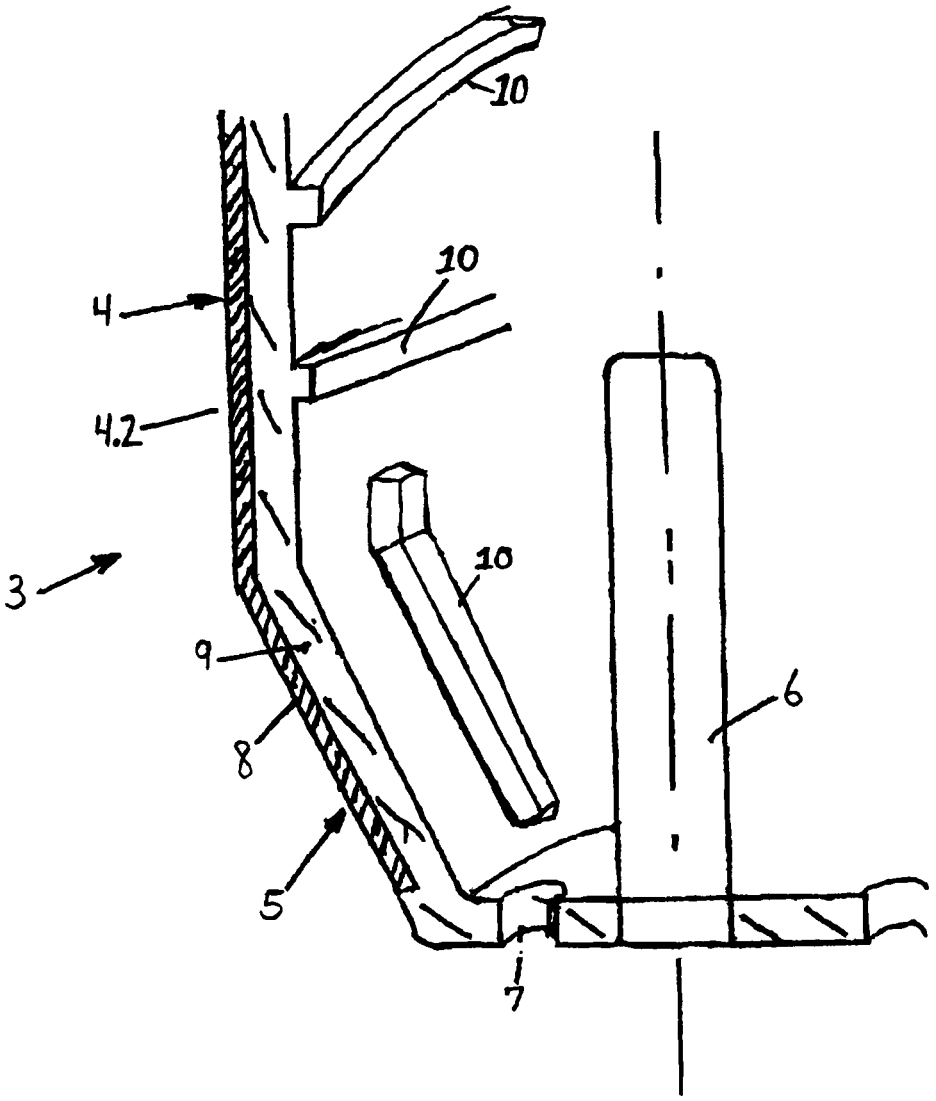
FIG. 2 shows a partial representation of a section through the jacket or the wall of a container cell of the container basket in one possible embodiment of the present application.

The container basket, given the general reference 1 in FIGS. 1 and 2, essentially comprises a box-like cell carrier 2 that is, in at least one possible embodiment, produced from corrosion-resistant sheet steel, and a plurality of bottle or container cells 3, which are each fitted into accommodating means of the cell carrier 2 and are held on said cell carrier so as not to twist and so as to be secured in position, for example by means of locking.

The container basket 1 is a component of a container cleaning machine (not represented) for cleaning bottles or similar bottle-like containers and, in this case in at least one possible embodiment of the present application, is a component of a transport system of the container cleaning machine with a plurality of similar-type container baskets 1, which are held with their cell carriers 2, in each case at both ends by way of securing lugs 2.2, on circulating transport elements, for example on circulating transport conveyors and by way of which the containers to be cleaned are moved through cleaning and processing zones of the cleaning machine.

The general shaping of the container cells 3 is roughly adapted to the shaping of the containers or bottles to be cleaned, i.e. the jacket or the wall of each container cell 3 is composed of a tubular section 4, which in the embodiment represented has a substantially polygon-like or quadratic outer and inner cross section with rounded corners and in the representation in FIG. 1 is open at the upper side of the container basket 1 or forms at that location the open bottle or container cell end, and of a mouth region or section 5, which connects to the section 4 downward and tapers in the manner of a truncated cone. The respective container accommodated in the container cell 3 abuts against the section 5 with its mouth region.

The section 4 protrudes by way of a part section beyond the top side of the cell carrier 2 and is accommodated by way of a part section in the cell carrier 2. The section 5 protrudes beyond the underside of the cell carrier 2. In order to make the processing of the container that is accommodated in the container cell 3 possible, openings 6 and 7 are provided in the wall of the container cell 3, in one possible embodiment also a plurality of openings 7 are provided on the bottom of the section 5.

In one possible embodiment, the container cells 3 is that cell jacket or cell wall, at least in the entire region 4, in at least one possible embodiment of the present application, however also in the region 5 and consequently at all times or substantially all times or essentially all times over the larger part of the length of the container cell, is multi-layered, i.e. at least two-layered, namely produced by at least one layer made from a first material for the desired strength with a small specific thermal capacity and by at least one further layer made from a second material, which, among other things, is used to protect the containers. The first material, in this case, for example, is metal, the second material is a suitable plastics material, for example a fiber-reinforced plastics material, e.g. glass fiber reinforced plastics material. In this context, the container cells 3 in the embodiment represented comprise the support body 8, which forms at least the larger part of the outside or outside surface of the container cells 3 and is produced, in at least one possible embodiment, from corrosion-resistant sheet steel, and also a layer or coating 9 of plastics material, for example fiber-reinforced plastics material, e.g. glass fiber-reinforced plastics material, in at least one possible embodiment of the present application, forming the entire container cell inside surface.

The support body 8 is produced, for example, as an embossed-molded or hydro-molded sheet metal part, using, in at least one possible embodiment of the present application, a corrosion-resistant steel plate with a material thickness in the range between approximately 0.7 millimeters to one millimeter. The production of the support body 8 is then effected, for example, such that in each case two support bodies or halves are formed from the steel plate and are then joined together before the plastics material layer is applied. The basic raw material used for producing the support body 8 can also be a thin-walled metal or steel pipe.

The plastics material layer 9 is formed, for example, by a fiber-reinforced plastics material and/or is applied, for example, by sintering, spraying, immersion or any other suitable manner with corresponding shaping of the container inside surface.

Figure 2A:
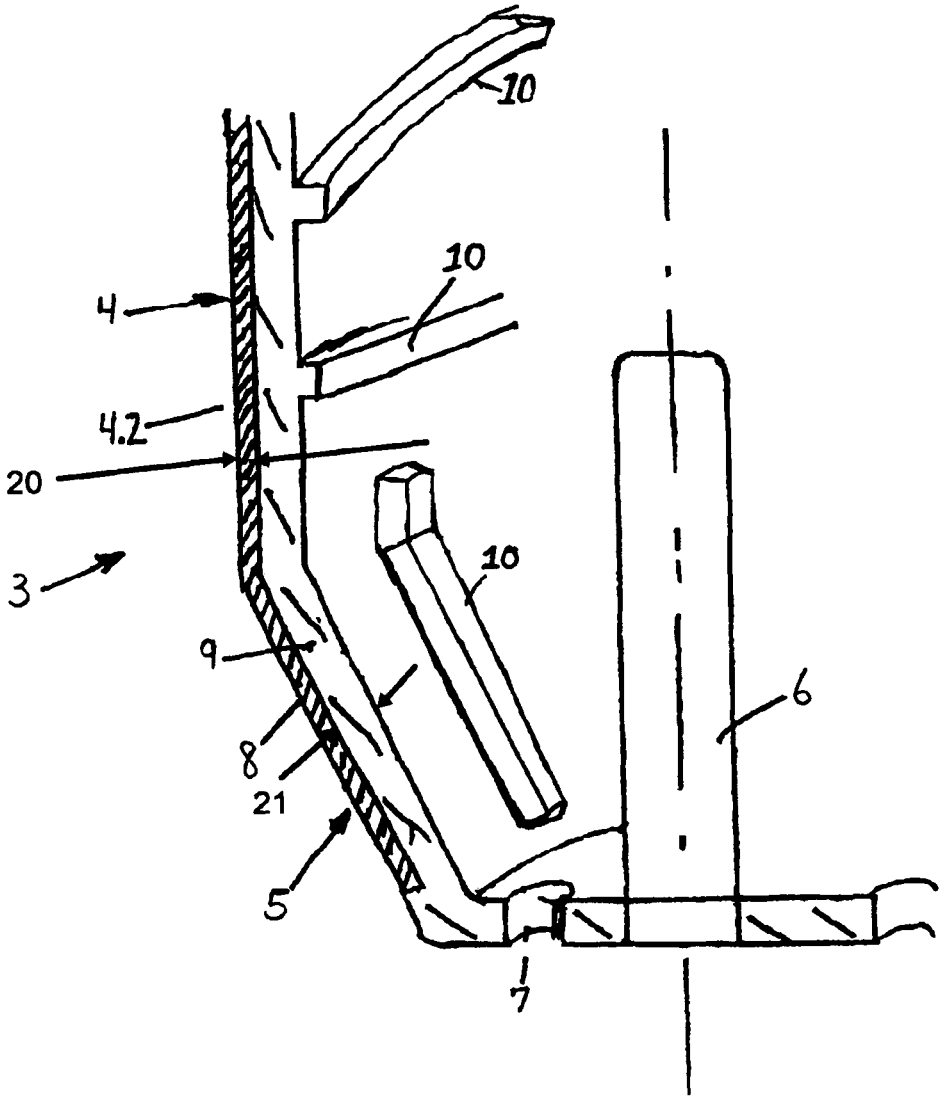
FIG. 2A shows a partial representation of a section through the jacket or the wall of a container cell of the container basket in one possible embodiment of the present application, similar to that seen in FIG. 2.

FIG. 2A shows one possible embodiment of the present application. The support body 8 comprises a thickness 20 which is sufficiently thick to provide structural rigidity to the support body 8 and cell 3, while additionally being sufficiently thin to minimize and/or restrict the thermal capacity of the cell 3. The thickness 20 of the support body 8 may range from about seven-tenths of a millimeter to about one millimeter. The thickness 21 of the plastic portion 9 may be twice the value of the thickness 20 of the support body 8. In other words, and in accordance with at least one possible embodiment of the present application, the plastic layer 9 may be twice as thick as the support body 8. In other possible embodiments of the present application, the ration between the thickness of the support body to the thickness of the plastic layer may be lesser or greater in increments of tenths of a millimeter.

Figure 3:
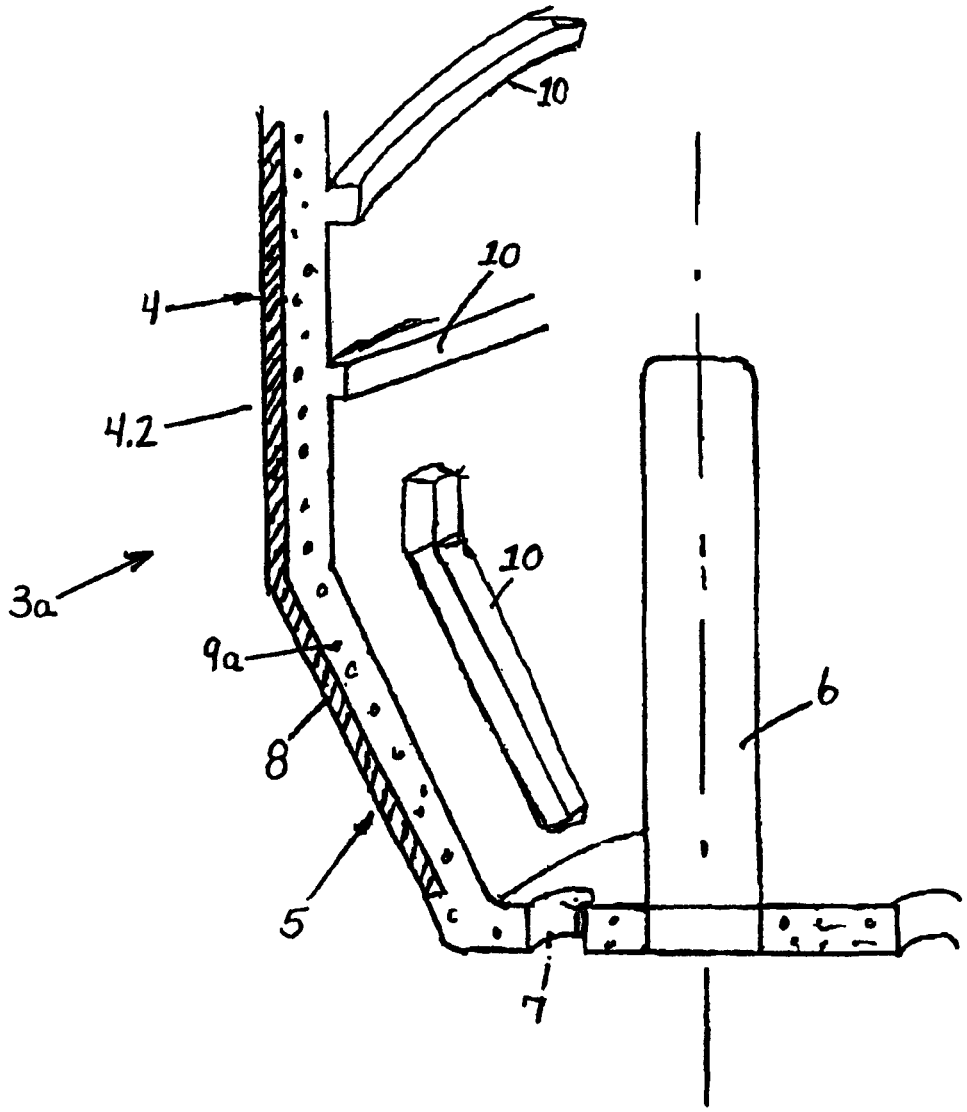
FIG. 3 shows a partial representation of a section through the jacket or the wall of a container cell of the container basket in one possible embodiment of the present application.

As a further embodiment and in a representation as in FIG. 2, FIG. 3 shows a container cell 3*a*, which differs from the container cell 3 substantially in that a plastics material layer 9*a* made from a foamed plastics material is used in place of the plastics material layer 9. The plastics material layer 9*a* is provided on the support body 8, for example, in a shaping method or in an in-mold method or is injected on to said support body. In principle, it is also possible to produce the plastics material layer 9*a* initially as a foamed plastics material molded part and then to join it to the support body 8. The plastics material layer 9*a*, at least on its exposed surface sides, is realized as a closed-cell layer with as smooth a surface as possible. The function elements once again shown schematically in FIG. 3 with the reference 10 are, for example, components of the plastics material 9*a* or are integrally molded to said layer, among other things for an optimum positioning and/or holding of the containers to be cleaned, for the creation of optimum flow conditions in the container cell 3*a* and for improved cleaning of container regions that are difficult to access and for protected processing, etc.

In at least one possible embodiment of the present application, the function elements 10 may be configured to clamp and/or hold containers or bottles in place in the container or bottle cell 3, and/or position the containers or bottles for optimal cleaning and/or treating of the containers or bottles. The vertical or substantially vertical function elements 10 in the cells 3 may be configured to hold and/or clamp and/or position the necks of the containers or bottles disposed in the cells 3. The horizontal or substantially horizontal function elements 10, which may be circular or annular, may be configured to clamp and/or hold and/or position the containers or bottles in the area of the body of the containers or bottles around the labels. The position of the horizontal or substantially horizontal function elements 10 may permit loosening and/or removing of labels from the containers or bottles. The position of the function elements 10 may permit a flow or swirling of cleaning or treatment medium around the bottle or container in order to provide optimal cleaning or treating of the container or bottle.

In one possible embodiment of the present application the function elements 10 may not be in contact with the mouth of the container and/or the neck rings or lips of the bottle or container. Also, the function elements 10 may not be in contact with the areas of the containers or bottles on which there are labels. This may promote loosening and/or removal of labels from the bottles or containers during cleaning or treatment. The function elements 10 may be disposed to permit swirling of cleaning medium or treatment medium around the bottles or containers in order to promote loosening and/or removal of labels.

In one possible embodiment of the present application, among other things, during the shaping process, when the plastics material layer 9 or 9*a* is applied, the container cell inside surface of the container cell 3 or 3*a* can be realized with regard to its shape, its sequence, its structuring, and with regard to integrally molded function elements (item 10 in FIGS. 2 and 3), etc. in a simplified production process in such a manner as is desired for, among other things, optimum positioning and/or holding of the containers to be cleaned, in at least one possible embodiment of the present application, also for clamping containers, in at least one possible embodiment, PET bottles, optimum flow conditions for a cleaning or processing medium in the container cells 3, also for the creation of a flow with swirling for the improved loosening and removing of labels or label residue, improved cleaning of container regions that are difficult to access, for example container neck rings, protective processing of the containers, etc.

In addition, the closed end of the respective container cell 3 or 3*a*, in at least one possible embodiment of the present application, is realizable with the openings 7 forming a grid-like structure at that location in one possible embodiment by means of correspondingly shaping the plastics material layer 9 or 9*a*.

To reduce abrasion, a surface coating with nano-particles (e.g. with carbon nano-fiber material) or produced from a compound comprising the nano-particles in a suitable matrix, e.g. a polymer matrix, can be provided on the container cells 3 or 3*a* as an additional layer or coating, in at least one possible embodiment of the present application, on the inside surfaces of the container cells 3 or 3*a*, in at least one possible embodiment, wherever the containers are contacted, as is indicated in FIG. 2 for the container cells 3 with the layers 9.1 and 10.1.

The support body 8 provides the container cell 3 or 3*a* with a sufficiently high degree of stability so that whilst retaining the optimum shaping of the container inside surface for the positioning, holding and/or cleaning of the containers, the overall mass of the container cell 3 or 3*a* and, in this case, in at least one possible embodiment of the present application, also the mass of the plastics material can be kept small and there is a considerably reduced thermal capacity for the container cells 3 or 3*a* in comparison to conventional container cells produced from plastics material, with a considerable energy saving when the container cleaning machine is operating. Thus, for example, an energy saving of up to eighteen percent can be achieved using the described embodiment of the container cells 3 or 3*a* compared to conventional container cells produced from plastics material.

In at least one possible embodiment of the present application, the cell 3 may comprise an outer surface, which may comprise a metal such as steel. The metal of the cell 3 may completely surround a bottle, when the bottle is disposed in the cell 3, or may substantially surround the bottle, when the bottle is disposed in the cell 3. The metal or steel may comprise the support body 8 of the cell 3, which may extend from the mouth region 5 to the part section 4.1 and may include the part section 4.2. Steel may have a specific heat capacity of approximately five hundred Jules per kilogram per Kelvin (J/kgK). Specific heat capacity is the amount of heat required to change temperature of a given quantity of a substance by one degree. In other words, specific heat capacity is a material property that indicates the amount of energy a substance stores for each degree increase in temperature, on a per-unit mass basis, or the amount of heat per unit mass required to raise the temperature by one degree Celsius. Steel may also have a thermal conductivity of approximately sixteen Watts per meter per Kelvin (W/mK). Thermal conductivity is the quantity of heat transmitted through a unit thickness in a direction normal to a surface of unit area, due to a unit temperature gradient under steady state conditions. In other words, the thermal conductivity of a substance is an intrinsic property that indicates its ability to conduct heat. Steel does not have the ability to store a very large quantity of heat compared to a plastic material. Also once the ambient temperature decreases, the steel conducts the heat away from itself and dissipates the heat into the ambient surroundings.

In at least one possible embodiment of the present application, the cell 3 may comprise an inner surface, which may comprise a plastic material. Plastic may have a specific heat capacity which is greater than the specific heat capacity of steel. For example, foam plastic may have a specific heat capacity of approximately 1300 Jules per kilogram per Kelvin. Solid plastic may have a specific heat capacity of approximately 1670 Jules per kilogram per Kelvin. Teflon (polytetrafluoroethylene or PTFE) may have a specific heat capacity of approximately 1400 Jules per kilogram per Kelvin. Polycarbonate may have a specific heat capacity of approximately 1300 Jules per kilogram per Kelvin. Polyethylene may have a specific heat of approximately 1000 Jules per kilogram per Kelvin. Polypropylene may have a specific heat of approximately 2000 Jules per kilogram per Kelvin. Polystyrene may have a specific heat of approximately Jules per kilogram per Kelvin.

Plastic has thermal conductivity which is lower than steel. For example, foam plastic may have a thermal conductivity of approximately 0.03 Watts per meter per Kelvin. Teflon may have a thermal conductivity of approximately 0.25 Watts per meter per Kelvin. Polycarbonate may have a thermal conductivity of approximately 0.22 Watts per meter per Kelvin. Polyethylene may have a thermal conductivity of approximately 0.51 Watts per meter per Kelvin. Polypropylene may have a thermal conductivity of approximately 0.22 Watts per meter per Kelvin. Polystyrene may have a thermal conductivity of 0.03 Watts per meter per Kelvin. Plastic has the ability to store a larger quantity of heat compared to a metal material. Also once the ambient temperature decreases, plastic does not conduct the heat away from itself and does not dissipate the heat into the ambient surroundings. Because plastic does not conduct heat away quickly, the plastic material of the cell 3 retains heat.

In one possible embodiment of the present application, the support body 8, which may comprise a metal such as sheet metal. The metal may be sufficiently thick to provide structural strength and minimize distortion of the shape of the cell 3. The layer of plastic 9 may be sufficiently thin to minimize thermal capacity, and the layer of plastic 9 may be sufficiently thick to protect and/or cushion containers or bottles from damage during processing. The layer of plastic 9, in combination with the thickness of the metal support body 8, may be sufficiently thick to minimize thermal capacity of the cell 3. By lowering the thermal capacity of the cells 3, the cleaning machine may not require and/or desire as much energy to heat the cells 3 of the cleaning machine, which may increase the efficiency of the cleaning machine. In one possible embodiment of the present application, the metal of the support body 8 may be maximized and the plastic layer 9 may be minimized, in order to promote a lower thermal capacity and to promote increased efficiency, when compared to cells 3 made of substantially only plastic, and also in order to sufficiently protect the containers or bottles from substantial damage during processing.

The embodiment according to the present application therefore may permit an optimum shaping of the container cell inside surface while possibly permitting a considerable reduction in thermal capacity and consequently a considerable energy saving when a cleaning machine is operating.

Figure 4:
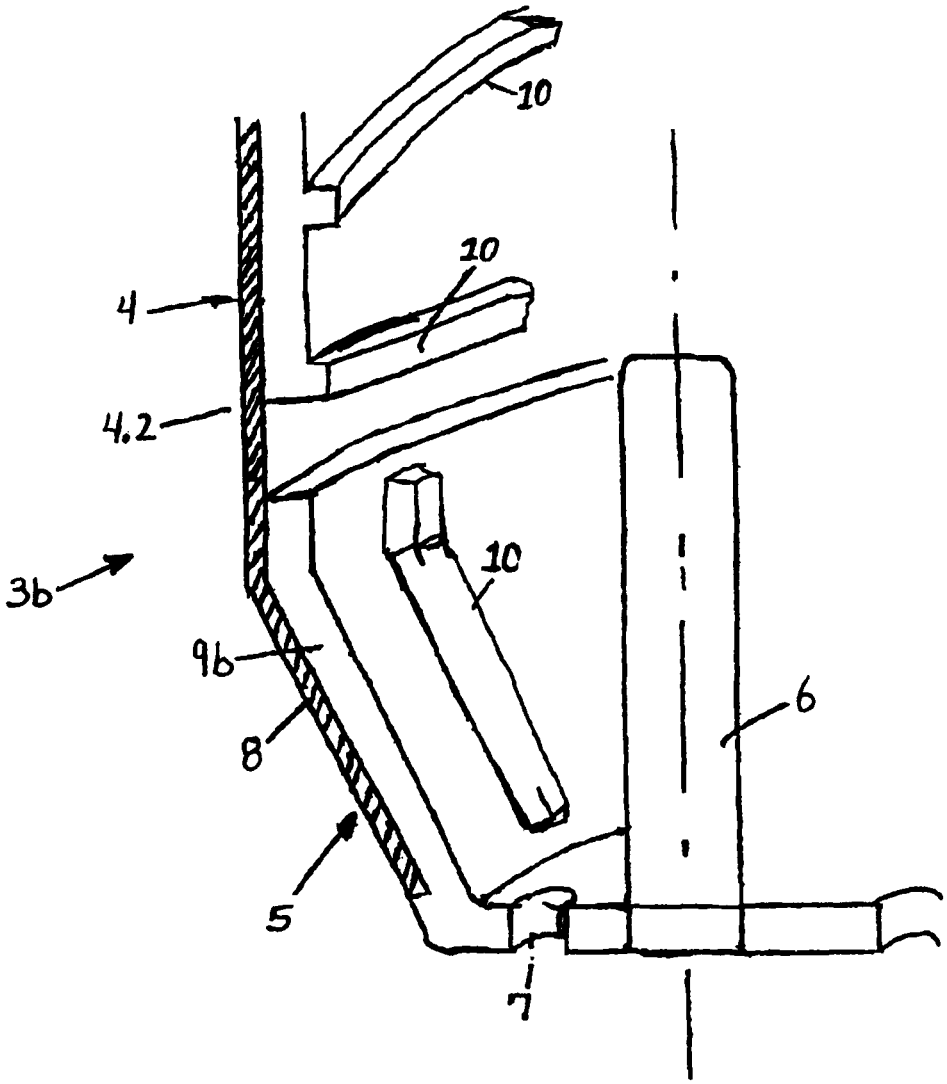
FIG. 4 shows a partial representation of a section through the jacket or the wall of a container cell of the container basket in one possible embodiment of the present application.

As a further embodiment, FIG. 4 shows a container cell 3*b*, which differs from the container cells 3 and 3*a* in that the plastics material layer 9*b* that corresponds to the plastics material layer 9 or 9*a* is applied in part, thereby producing a further reduction in the overall mass of plastics material. The application in part can be effected in the most varied manner, for example by the plastics material layer 9*b* being applied in the manner of a dot and/or dash or in the manner of a grid, or also, however, being provided with corresponding openings or windows.

If the container cells 3, 3*a*, and 3*b* are provided with a plastics material layer on their outside surface, this can also be effected in part in the afore-described manner.

The present application has been described above by way of possible embodiments. It is obvious that numerous modifications and conversions are possible, without in any way departing from the teaching concept underlying the present application.

Thus, it has been assumed above that the plastics material layer 9 is provided simply on the container cell inside. In principle, however, it is also possible for the respective support body 8 to be provided with a plastics material layer also on the outside in order, in this manner, to realize more complicated shapes or structures on the bottle or container cell outside surface through a simplified shaping process, said shapes and structures being used, for example, for the simplified securing of the container cells on the cell carrier 2, etc.

In addition, it is possible for the container cells 3 or 3*a* to have on their inside and/or outside plastics material layers that differ with regard to the type of plastics material used, the characteristics of said material, the additions used, in at least one possible embodiment also the filler, etc. but which meet the respective requirements and/or desired specifications.

Figure 5:
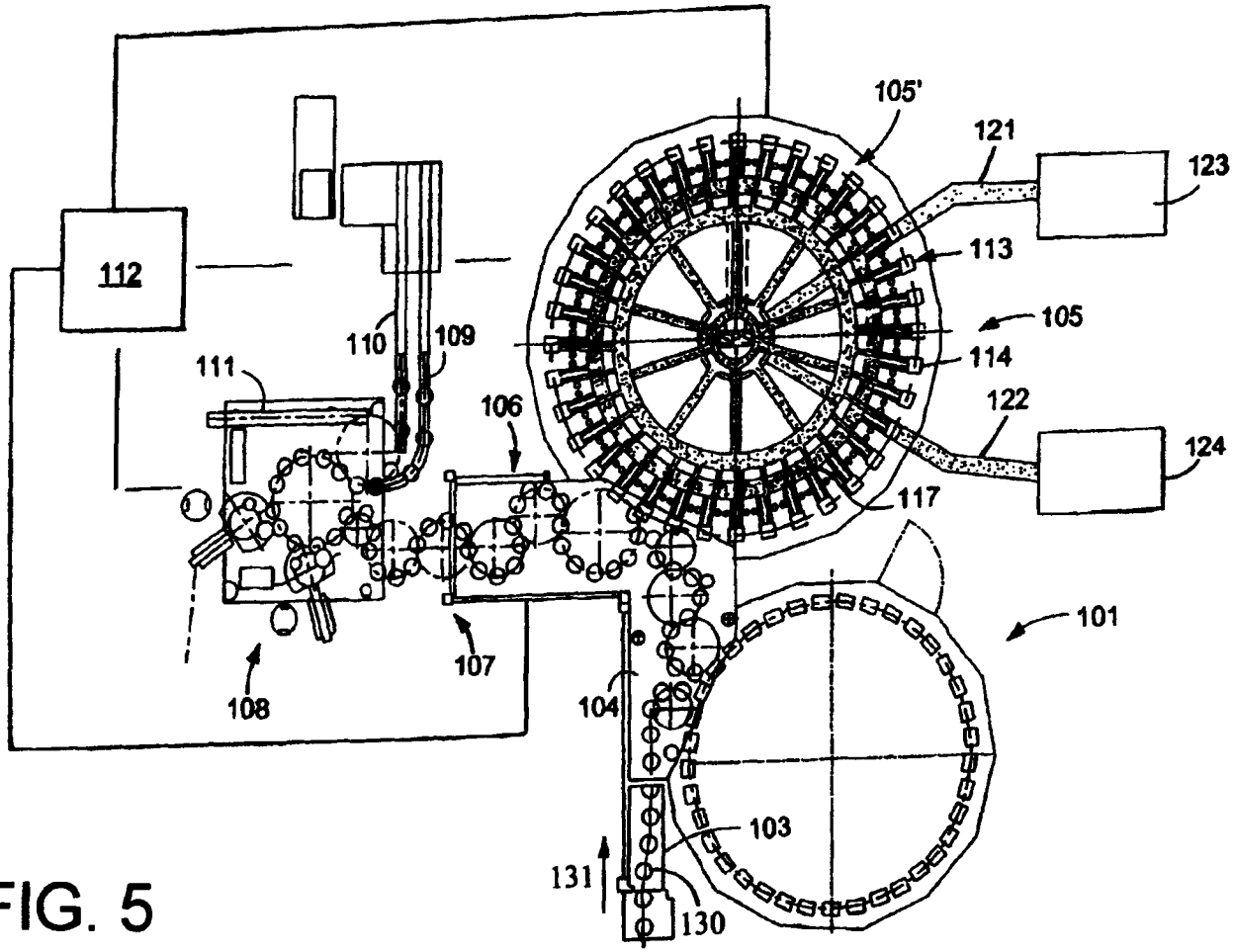
FIG. 5 shows schematically the main components of one possible embodiment example of a system for filling containers, for example, a beverage bottling plant for filling bottles with at least one liquid beverage, in accordance with at least one possible embodiment, in which system or plant could possibly be utilized at least one aspect, or several aspects, of the embodiments disclosed herein.

FIG. 5 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 5 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 5, there are two external supply reservoirs 123 and 124, each of which is configured to store either the same liquid beverage product or different products. These reservoirs 123, 124 are connected to the toroidal or annular vessel by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The present application relates to a container cell for a container cleaning machine, in at least one possible embodiment to a bottle cleaning machine with a cell interior space surrounded by a cell mantle and with a cell interior surface made of plastic to hold a container for cleaning.

One feature or aspect of an embodiment is believed at the time of the filing of this patent application to possibly reside broadly in a container cell of a container cleaning machine, in at least one possible embodiment a bottle cleaning machine, the container cell having a cell interior space that is surrounded by a cell jacket 4, 5 with a container cell inside surface made of plastics material for accommodating a container to be cleaned, wherein the cell jacket 4, 5, at least over the larger part of the length of a container cell, is multi-layered produced at least from one thin-walled cell body or support body 8 made of a first material, and from at least one layer 9, 9*a*, 9*b* forming the container cell inside surface made of a second material.

Another feature or aspect of an embodiment is believed at the time of the filing of this patent application to possibly reside broadly in the container cells, wherein the first material is metal, for example steel.

Yet another feature or aspect of an embodiment is believed at the time of the filing of this patent application to possibly reside broadly in the container cells, wherein the second material is plastics material, for example fiber-reinforced and/or foamed plastics material.

Still another feature or aspect of an embodiment is believed at the time of the filing of this patent application to possibly reside broadly in the container cell, wherein the cell body or support body 8 forms the outside surface of the container cell at least over the larger part of the length of the container cell.

A further feature or aspect of an embodiment is believed at the time of the filing of this patent application to possibly reside broadly in the container cell, wherein the container cell inside surface is realized by the molding of the plastics material with a shaping or structuring 10 that optimizes the positioning and/or holding and/or cleaning of the containers.

Another feature or aspect of an embodiment is believed at the time of the filing of this patent application to possibly reside broadly in the container cell, wherein the plastics material layer 9, 9*a*, 9*b* is applied by spraying or injecting, by coating or sintering methods, by immersion and/or by foaming.

Yet another feature or aspect of an embodiment is believed at the time of the filing of this patent application to possibly reside broadly in the container cell, wherein the cell or support body 8 is thin-walled, for example realized with a material thickness in the range between approximately 0.7 millimeters and one millimeter.

Still another feature or aspect of an embodiment is believed at the time of the filing of this patent application to possibly reside broadly in the container cell, wherein the cell body or support body 8 is produced from sheet metal by means of consistent or substantially consistent or intermittent deformation, for example as an embossed-molded or hydro-molded sheet metal part.

A further feature or aspect of an embodiment is believed at the time of the filing of this patent application to possibly reside broadly in the container cell, wherein the cell body or support body 8 is produced from a thin-walled tube.

Another feature or aspect of an embodiment is believed at the time of the filing of this patent application to possibly reside broadly in the container cell, wherein the cell jacket has a substantially tubular section 4 forming an open end of the container cell and a tapering section 5, for example tapering in the manner of a truncated cone, and in that the cell body or support body 8 extends at least over the entire region of the tubular section 4, in at least one possible embodiment, also at least over a part of the tapering section 5.

Yet another feature or aspect of an embodiment is believed at the time of the filing of this patent application to possibly reside broadly in the container cells, wherein the cell body or support body 8 extends over the entire length of the tapering section 5.

One feature or aspect of an embodiment is believed at the time of the filing of this patent application to possibly reside broadly in the container cell, wherein a surface coating 9.1, 10.1 with nano-particles or produced from a compound containing nano-particles in a suitable matrix, e.g. polymer matrix, is provided to minimize abrasion, in one possible embodiment on the inside surfaces of the container cell 3, 3*a*, 3*b*.

Another feature or aspect of an embodiment is believed at the time of the filing of this patent application to possibly reside broadly in a container basket for a container cleaning machine, the container basket comprising a cell carrier 2 and a plurality of container cells 3, 3*a*, 3*b* provided on the cell carrier 2, wherein the container cells 3, 3*a*, 3*b* are realized according to the present application.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

In one possible embodiment of the present application, Teflon may be utilized or adapted for use in at least one possible embodiment of the present application. Teflon is manufactured by DuPont, which is headquartered in Wilmington, Del., USA.

Some examples of a plastic material with nanoparticles may be manufactured by Wright Materials Research Co., which is located at Richfield Center, Beavercreek, Ohio 45430 USA; Nanostructured & Amorphous Materials, Inc., 16840 Clay Road, Suite #113, Houston, Tex. 77084 USA; Blue Nano, 16925 Pennington Drive, Huntersville, N.C. 28078, USA; Catalyx Nanotech, 1200 N. Van Buren, Suite A, Anaheim, Calif. 92807 USA; eSpin Technologies, 7151 Discovery Drive, Chattanooga, Tenn. 37416 USA; and Five Star Technologies, 21200 Aerospace Parkway, Cleveland, Ohio 44142 USA. Another example of a material which may be utilized or adapted for use in at least one possible embodiment of the present application may possibly be found in the U.S. Pat. No. 6,639,012, having the title "High rubber impact modifier powders," published on Oct. 28, 2003.

The following patents, patent applications or patent publications, are hereby incorporated by reference as if set forth in their entirety herein except for the exceptions indicated herein: DE 195 42 673 A1, having the title "Cleaning machine for bottles with station for treatment and conveyor," published on May 22, 1997; and DE 42 42 375 A1, having the following German title "Flaschenzelle mit Zellenträger," published on Jun. 23, 1994.

Some examples of cleaning machines or machines configured to transport containers or bottles into cleaning machines, which may possibly be utilized or adapted for use in at least one possible embodiment of the present application, may possibly be found in the following: U.S. Pat. No. 7,392,632, having the title "Beverage bottling plant with beverage bottle handling machines having beverage bottle transfer stations and a method of operation thereof," published on Jul. 1, 2008; and U.S. Patent Application Publication No. 2009/0211606, having the title "METHOD OF CLEANING BOTTLES IN A BOTTLE CLEANING MACHINE, AND AN ARRANGEMENT FOR PERFORMING THE METHOD, AND A BOTTLE CLEANING MACHINE," published on Aug. 27, 2009.

Some examples of apparatus and methods of sterilizing or cleaning containers that may possibly be utilized or possibly adapted for use in at least one possible embodiment of the present application may possibly be found in the following U.S. Pat. No. 5,092,356 issued to Grot on Mar. 3, 1992; U.S. Pat. No. 5,320,144 issued to Ahlers on Jun. 14, 1994; U.S. Pat. No. 5,533,552 issued to Ahlers on Jul. 9, 1996; U.S. Pat. No. 5,558,135 issued to Kronseder et al. on Sep. 24, 1996; and U.S. Pat. No. 5,896,899 issued to Schlitz on Apr. 27, 1999.

The Innoclean SEC bottle washing machine, manufactured by KHS AG, is an example of a bottle washer which may possibly be utilized or adapted for use in at least one possible embodiment. Some other examples of bottle washers or bottle rinsers which may possibly be utilized or adapted for use in at least one possible embodiment, which are also manufactured by KHS AG, may include: the Innoclean FR-ZR, the Innoclean FR-DR, the Innoclean FR-ZM, and the Innoclean FR-EM.

All of the patents, patent applications or patent publications, except for the exceptions indicated herein, which were cited in the International Search Report dated May 29, 2009, and/or cited elsewhere are hereby incorporated by reference as if set forth in their entirety herein, as follows: DE 89 14 691 U1 having the following German title "Flaschenzelle," published on Feb. 1, 1990; DE 86 33 675 U1 having the following German title "Flaschenzelle," published on Apr. 23, 1987; EP 1 473 079 A1 having the title "Method and apparatus for controlling the movement of a liquid on a nanostructured or microstructured surface," published on Nov. 3, 2004; and DE 25 57 356 B1 having the following German title "Flaschenkasten zur Aufnahme and zum Transport von Getränkeflaschen durch Flaschenreinigungsmaschinen," published on Mar. 31, 1977.

The patents, patent applications, and patent publications listed above in the preceding paragraphs are herein incorporated by reference as if set forth in their entirety except for the exceptions indicated herein. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

The corresponding foreign and international patent publication applications, namely, Federal Republic of Germany Patent Application No. 10 2007 049 724.7, filed on Oct. 16, 2007, having inventors Klaus JENDRICHOWSKI, Falk DITTRICH, Ulrich WIEDEMANN, Elmar HEIN, and Bernd MOLITOR, and DE-OS 10 2007 049 724.7 and DE-PS 10 2007 049 724.7, and International Application No. PCT/EP2008/008707, filed on Oct. 15, 2008, having WIPO Publication No. WO2009/049865 and inventors Klaus JENDRICHOWSKI, Falk DITTRICH, Ulrich WIEDEMANN, Elmar HEIN, and Bernd MOLITOR, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, except for the exceptions indicated herein, are hereby incorporated by reference as if set forth in their entirety herein.

The purpose of incorporating the corresponding foreign equivalent patent applications, that is, PCT/EP2008/008707 and Federal Republic of Germany Patent Application 10 2007 049 724.7, is solely for the purpose of providing a basis of correction of any wording in the pages of the present application, which may have been mistranslated or misinterpreted by the translator. However, words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments of the patents, patent applications, and patent publications, are not generally considered to be incorporated by reference herein.

Statements made in the original foreign patent applications PCT/EP2008/008707 and DE 10 2007 049 724.7 from which this patent application claims priority which do not have to do with the correction of the translation in this patent application are not to be included in this patent application in the incorporation by reference.

Any statements about admissions of prior art in the original foreign patent applications PCT/EP2008/008707 and DE 10 2007 049 724.7 are not to be included in this patent application in the incorporation by reference, since the laws relating to prior art in non-U.S. Patent Offices and courts may be substantially different from the Patent Laws of the United States.

All of the references and documents cited in any of the documents cited herein, except for the exceptions indicated herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Container basket
2 Cell carrier
3, 3*a*, 3*b* Container or bottle cell
4, 5 Section of the container cell or container cell wall
4.1, 4.2 Part section
6, 7 Opening
8 Support body made of corrosion-resistant steel plate
9, 9*a*, 9*b* Plastics material layer
9.1, 9.2 Layers
10 Structuring on the container carrier inside surface

What is claimed is:

1. A cleaning machine container cell comprising:
an elongated, hollow body configured to receive a container;
said body being configured to be inserted into a cell carrier of a cleaning machine;
said body comprising a length substantially similar to a container to be received therein;
said body comprising a wall;
said wall comprising an inner layer comprising a first material and an outer layer comprising a second, different material;
said outer layer contacts and covers at least a substantial portion of said inner layer; and
said second material is a foamed plastic.

2. The cleaning machine container cell according to claim 1, wherein said second material comprises metal.

3. The cleaning machine container cell according to claim 2, wherein said foamed plastic material comprises a fiber-reinforced plastics material.

4. The cleaning machine container cell according to claim 3, wherein said outer layer forms an outside surface of said container cell at least over a substantial portion of the length of said container cell.

5. The cleaning machine container cell according to claim 4, wherein said inner layer has an inner surface shaped for positioning, holding, or cleaning of the containers, which inner surface comprises moldings or other support structures.

6. The cleaning machine container cell according to claim 5, wherein said inner layer comprises a sprayed-on layer, a coating, a sintered layer, a layer formed by immersion of said outer layer, or a foamed layer.

7. The cleaning machine container cell according to claim 6, wherein said outer layer has a thickness in the range of between approximately 0.7 mm and 1.0 mm.

8. The cleaning machine container cell according to claim 7, wherein said outer layer comprises deformed, embossed, or molded sheet metal, or is formed from a thin-walled tube.

9. The cleaning machine container cell according to claim 8, wherein said cell body comprises a substantially tubular section which forms an open end, and a tapering section extending from said tubular section, and said outer layer extends over at least said tubular section.

10. The cleaning machine container cell according to claim 9, wherein said outer layer additionally extends over a portion of said tapering section.

11. The cleaning machine container cell according to claim 10, wherein said outer layer extends over the entirety of said tapering section.

12. The cleaning machine container cell according to claim 11, wherein said container cell comprises a surface coating containing nano-particles disposed on an inner surface thereof and configured to minimize abrasion of containers.

13. A cleaning machine container cell comprising:

an elongated, hollow body configured to receive a container;

said body being configured to be inserted into a cell carrier of a cleaning machine;

said body comprising a length substantially similar to a container to be received therein;

said body comprising a wall;

said wall comprising an inner layer comprising a first material and an outer layer comprising a second, different material;

said outer layer contacts and covers at least a substantial portion of said inner layer;

said body is substantially tubular and comprises a first opening disposed at a first end of said body, through which first opening a container may be inserted into said body;

said body comprises a closed portion at a second end of said body opposite said first end;

said closed portion comprises at least one second opening therein to permit flow of cleaning liquid in through said at least one second opening, through said body, and out through said first opening, and vice versa; and said at least one second opening comprises a slot-shaped opening that extends along a portion of a side wall of said body.

14. The cleaning machine container cell according to claim 1, wherein:

said inner layer comprises function elements comprising projections, ribs, or other similar structures that project out from an inner surface of said inner layer; and said function elements are configured and disposed to direct flow of cleaning liquid, or generate a swirling of cleaning liquid, around a container in said container cell, to promote cleaning of a container in said container cell.

15. The cleaning machine container cell according to claim 14, wherein said function elements are configured and disposed to assist in the loosening and/or removal of a label from a container in said container cell.

16. The cleaning machine container cell according to claim 1, wherein said outer layer comprises a material being sufficiently strong to provide at least a substantial portion of the mechanical stability of said container cell.

17. The cleaning machine container cell according to claim 16, wherein said outer layer comprises corrosion-resistant sheet steel.

18. The cleaning machine container cell according to claim 1, wherein said outer layer and said inner layer are permanently joined together.

* * * * *